US011518572B2

(12) United States Patent
Ceré et al.

(10) Patent No.: US 11,518,572 B2
(45) Date of Patent: Dec. 6, 2022

(54) MEASURING SYSTEM AND METHOD FOR PALLETIZED LOADS

(71) Applicant: AETNA GROUP S.P.A., Verucchio (IT)

(72) Inventors: Mauro Ceré, Loiano (IT); Massimiliano Vaccari, Verruchio (IT)

(73) Assignee: AETNA GROUP S.P.A., Verucchio (IT)

( * ) Notice: Subject to any disclaimer, the term of this patent is extended or adjusted under 35 U.S.C. 154(b) by 588 days.

(21) Appl. No.: 16/603,295

(22) PCT Filed: Apr. 5, 2018

(86) PCT No.: PCT/IB2018/052370
§ 371 (c)(1),
(2) Date: Oct. 7, 2019

(87) PCT Pub. No.: WO2018/185704
PCT Pub. Date: Oct. 11, 2018

(65) Prior Publication Data

US 2021/0331833 A1 Oct. 28, 2021

(30) Foreign Application Priority Data

Apr. 7, 2017 (IT) ..... 102017000038392

(51) Int. Cl.
*B65D 19/38* (2006.01)
*B65D 71/00* (2006.01)

(52) U.S. Cl.
CPC ..... *B65D 19/38* (2013.01); *B65D 71/0092* (2013.01); *B65D 2519/00323* (2013.01);
(Continued)

(58) Field of Classification Search
CPC ..... B65D 19/38; B65D 71/0092; B65D 2571/00012
(Continued)

(56) References Cited

U.S. PATENT DOCUMENTS 4,750,197 A * 6/1988 Denekamp ..... G07C 5/008 235/375
2004/0082296 A1* 4/2004 Twitchell, Jr. ..... H04L 12/189 455/426.2
(Continued)

FOREIGN PATENT DOCUMENTS

CN 101045498 10/2007
CN 204489460 7/2015
(Continued)

OTHER PUBLICATIONS

International Search Report dated Jul. 6, 2018 in International (PCT) Application No. PCT/IB2018/052370.

*Primary Examiner* — Jose V Chen
(74) *Attorney, Agent, or Firm* — Wenderoth, Lind & Ponack, L.L.P.

(57) ABSTRACT

A measuring system associable with a group of products wrappable with a plastic film to form a palletized load. The system includes a supporting frame provided with a supporting plane for the group, first and second detecting modules housed inside the supporting frame and provided with first and second sensor units to detect and measure first and second physical quantities acting on the palletized load when it is moved and/or transported, a processing module having first and second computing units and first and second memory units positioned on the supporting plane, inserted among the products and having dimensions and weight comparable to that of one of the products. The first and second computing units, first and second memory units and
(Continued)

first and second detecting modules form first and second measurement chains of the first and second physical quantities.

20 Claims, 4 Drawing Sheets

(52) U.S. Cl.
CPC ..... *B65D 2519/00333* (2013.01); *B65D 2571/00012* (2013.01)

(58) Field of Classification Search
USPC ..... 108/51.11–57.34
See application file for complete search history.

(56) References Cited

U.S. PATENT DOCUMENTS

2005/0236479 A1* 10/2005 Schmidtberg ..... G06Q 10/087 235/384
2007/0295822 A1 12/2007 Kawai
2008/0103944 A1* 5/2008 Hagemann ..... G06Q 10/0833 108/51.11
2013/0160680 A1* 6/2013 Ten Bok ..... B29C 69/02 264/41
2014/0091196 A1 4/2014 Maas et al.
2015/0298854 A1* 10/2015 Linares ..... B65D 19/04 108/55.3
2019/0034863 A1* 1/2019 Winkle ..... B65D 19/02
2019/0235092 A1* 8/2019 Bastian, II ..... B65D 19/38
2020/0118065 A1* 4/2020 Li ..... H04W 4/80
2021/0009310 A1* 1/2021 Moeller ..... B65D 19/0095

FOREIGN PATENT DOCUMENTS

DE 295 00 449 5/1995
EP 1 818 271 8/2007
WO WO-2020216543 A1 * 10/2020 ..... B65D 71/0096

* cited by examiner

MEASURING SYSTEM AND METHOD FOR PALLETIZED LOADS

The invention relates to machines, systems and methods for wrapping with a plastic film products arranged on a pallet. In particular, the invention relates to a measuring system and a measuring method able to obtain data on physical quantities acting on a palletized load made of a group of products positioned on a pallet and wrapped by a plastic film, when the palletized load is moved and transported, for instance from the production place to the delivery place. The invention also relates to a method for wrapping a palletized load based on data relative to physical quantities measured by said measuring system.

It is known and widespread in the industrial packaging sector the use of film or web made of cold-stretchable plastic material for wrapping and fastening to a pallet a plurality of products, objects, packages duly stacked in layers and grouped so as to form a so called palletized load, which can easily be moved by a forklift and loaded on different types of transport means (truck, ship, plane, etc.). In particular, the products are wrapped and fastened together and with the pallet by dispensing the film so as to form a plurality of bands or stripes of film that are overlapped and twisted as a helix.

The plastic film is generally stretched or elongated, elastically and/or plastically, before being wrapped around the load. Typically, the plastic film is elastically stretched of a pre-set quantity or percentage in order to be used at its best and to achieve physical-mechanical characteristics such as to make it more suitable to stand the forces acting on the load when moved and transported. More precisely, when the stretching force applied to the film for elongating the latter ends, the elastic springback of the film thereof causes a tightening force on the load that allows to hold and contain the products composing the load and to tightly fasten the products to the underlying pallet. The wrapping tension or force applied to the film while wrapping around the load also contributes to such containment and wrapping effect.

Usually the film stretching or elongation is expressed in percentage as a ratio between the elongation of the film (difference between the final length of the stretched film and the original length) and the original length. Typically, the elongation or stretching exerted to the film is comprised between 50% and 400%.

The film stretching further allows to reduce significantly the thickness of the film (typically from about 20-25 μm to about 6-7 μm) so as to increase proportionally the length in order to wrap a wider perimeter of load with the same initial quantity of unwound film. This allows reducing the film consumption and thus the packaging costs.

The pre-stretching force also allows to change the mechanical characteristics of the film thereof. In fact, the film material when duly stretched may pass from an elastic behaviour, wherein the film tends to return to its original size once the stress is over, to a plastic behaviour, wherein the film undergoes a permanent deformation and does not return to its original size once the stress ceases. In this last case, the plastic material film behaves as a flexible and inextensible element, as a rope or belt, and may be used for example, to wrap groups of unstable products that must be kept tightly fastened together.

Therefore, in order to carry out an efficient and stable wrapping it is necessary to choose a suitable film of plastic material (composition, initial thickness) and define the correct wrapping parameters (pre-stretching percentage, wrapping force, number of film wrappings around the load, overlapping of the wrappings, etc.) in accordance both with the type of load (fragile, solid, unstable, irregular products, etc.) to be wrapped and the transport itinerary and/or the moving operations the load must undergo.

As known, a relevant percentage of palletized loads (especially in the beverage field, wherein the palletized loads are composed of a plurality of plastic bottles usually subgrouped in bundles) are irremediably damaged during the transport due to the stress (linear, angular speeds, accelerations/decelerations, vibrations, oscillations, etc.) they are subjected to. In fact, the load can bend laterally, undergo deformation and collapse locally, thus provoking damages and/or crushing and/or break of the single products.

In order to overcome suck drawbacks, a solution is wrapping the load as tightly as possible (consistently with the characteristics of the products contained) and with a high number of wrappings. However, not always such wrappings are free from problems and furthermore the consumption of film increases considerably, with a relevant impact on manufacturing costs.

Hence, it is highly perceived the need in the packaging field to optimize the procedures or wrapping cycles of palletized loads in order to obtain an optimal wrapping configuration which guarantees an optimal containment and stabilization of the load and, at the same time, a reduction of the quantity of film used, both according to the type of product composing the load and the transport type and itinerary of the palletized load.

To this end it is known measuring stresses (speed, acceleration) of the transport means (truck, ship, plane, etc.) on which the palletized load will be positioned. Data of the measured stresses are used to calculate and establish the correct wrapping parameters. However, these data are not precise and complete, as they do not take into consideration the composition and structure of the transported load and how the stresses are transmitted, also changing considerably, from the loading platform of the transport means to the load. In other cases, sensors are used which can be fixed outside the load to transmit data related to stresses acting on the load during the transport. However, positioning of sensors on the load can affect the measurement as sensors modify the structure, the weight and the dynamic behaviour of the load, wherein dynamic behaviour means the kinematic, dynamic, structural response or reaction of the load when subjected to stresses such as linear, angular speeds, accelerations/decelerations, vibrations, oscillations, etc.

Furthermore, sensors that are not optimally fixed to the load may undergo particular stresses (vibrations) which do not affect the whole load. Finally, sensors are particularly vulnerable, as they are exposed during transport and movement operations to impacts and collisions that can change measurements and/or damage and even break the sensors.

EP 1818271 discloses a device for loading and transporting a plurality of items or products, in particular a pallet, which internally contains communication units to communicate with electromagnetic reading/writing IC tags that are positioned on the transported items, sensor units for detecting and obtaining environment quantities, a GPS unit, a data receiving/transmitting unit and a transmitting antenna. In the pallet disclosed in EP 1818271 a controller is also mounted which receives data from the different units (communication unit, sensor unit, GPS unit) and is able to save the data in an inner memory. A rechargeable and removable battery is also housed inside the pallet. Two sensor units which are identical (they measure the same physical quantities) are provided for safety reasons and are positioned at the opposite sides of the pallet in order to guarantee correct and complete data acquisition even in case of damage or break of one of the two units (for instance as a consequence of impacts and collisions of the pallet). Each sensor unit comprises a temperature sensor, a humidity sensor and an impact sensor.

During the movement and the transport of the pallet and of the products placed therein, the controller is arranged to detect and save data coming from the sensors periodically, for example every 10, 30, 60 minutes, or when an impact or collision occurs to the pallet, that is when the impact sensor detects a stress higher than a threshold value.

The device disclosed in EP 1818271 is not able to measure in real time all the stresses (linear, angular speeds, accelerations/decelerations, vibrations, oscillations, etc.) the products are subjected to during the transport, but only the humidity and temperature values and an impact occurring (event). Furthermore, as the controller, the battery and all the different units are housed inside the pallet, the aforesaid pallet has structure, weight and mass distribution which differ greatly from those of a standard pallet having the same size. Therefore, its use may significantly affect the measurements as it modifies the weight and the dynamic behaviour of the palletized load wherein it is integrated.

An object of the present invention is to improve the known systems and methods for measuring and obtaining data related to physical quantities acting on a palletized load formed by a group of products, items, packages positioned on a pallet and wrapped by a plastic film, when said palletized load is moved and transported.

Another object is providing a measuring system and a measuring method that allow to detect and measure in a precise and accurate way kinematic and environmental physical quantities acting on a palletized load formed by a group of products wrapped by extensible/stretchable film during transport and movement.

A further object is providing a measuring system and a measuring method that can be used for any type of load and product, item or package and capable to measure the real stresses without introducing alterations or modifications.

In a first aspect of the invention a measuring system for a palletized load according to claim 1 is provided.

In a second aspect of the invention a method for measuring physical quantities acting on a palletized load according to claim 13 is provided.

In a third aspect of the invention it is provided a wrapping method according to claim 14 is provided.

The invention will be better understood and implemented with reference to the enclosed drawings showing an exemplifying and non-limiting embodiment, wherein.

Figure 1:
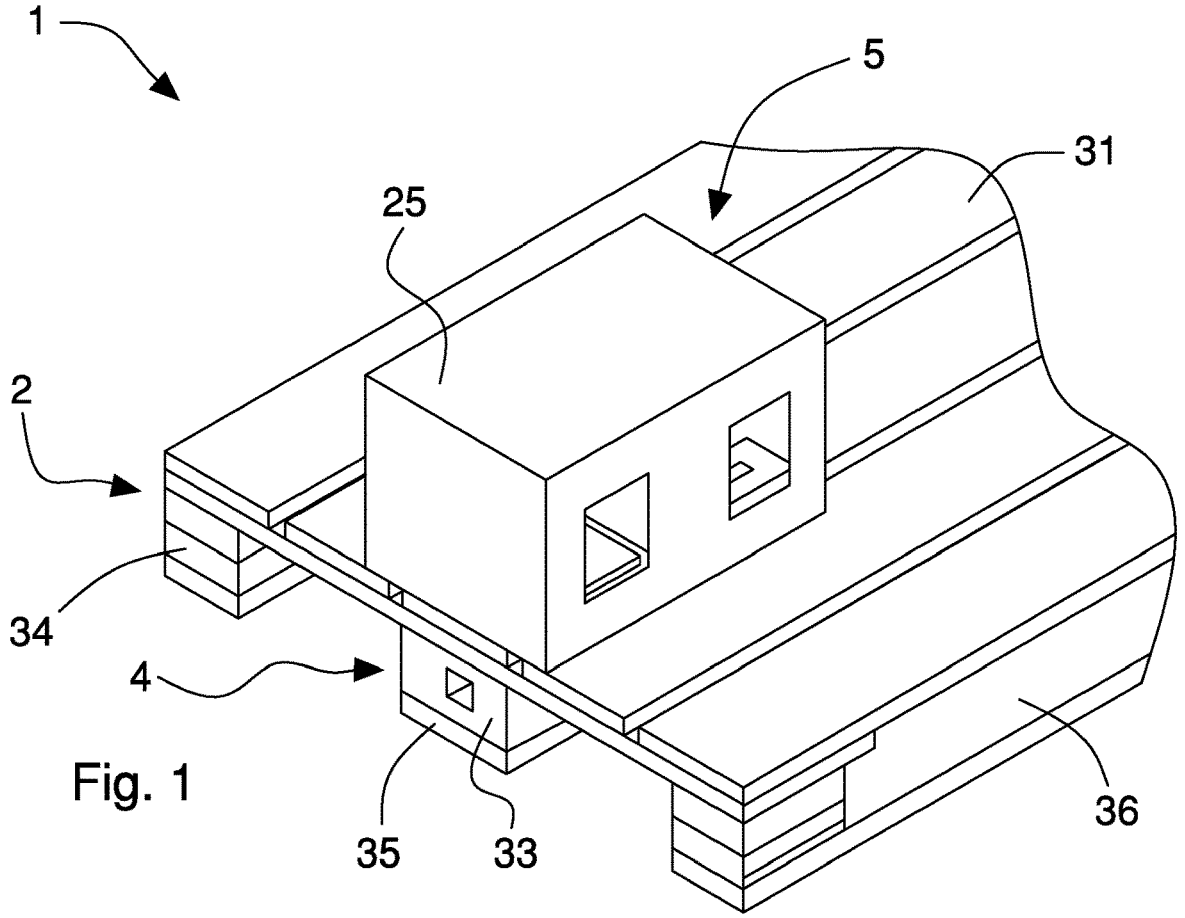
FIG. 1 is a perspective view of the measuring system of the invention, in particular showing a supporting frame for a load of products, a second detecting module and a processing module.

Referring to FIGS. 1 to 7, the measuring system 1 of the invention is shown that is associable to a group of products 100 to be wrapped with a film 50, in particular of the cold-stretchable type. The measuring system 1 can be wrapped with the plastic film 50 together with the group of products 100 in order to form a palletized load 110 and is arranged to measure a plurality of physical quantities a, co, t, p, u acting on said products 100 when the palletized load is moved and transported, for example by one or more means of transport along an itinerary.

The measuring system 1, otherwise called instrumented pallet, includes a supporting frame 2, or pallet, that is provided with a supporting plane 31 for the products 100, a first detecting module 3 and a second detecting module 4. The first detecting module 3 is housed inside the supporting frame or pallet 2 and is provided with first sensor means 13 to detect and measure with a first data acquisition time t1 first physical quantities a, co acting on the products 100 and on the measuring system 1 of the palletized load 110. The second detecting module 4 is housed inside the supporting frame 2 and is provided with second sensor means 14 to detect and measure with a second data acquisition time t2 second physical quantities t, p, u acting on the products 100 and on the measuring system 1 of said palletized load 110.

The measuring system 1 also includes a processing module 5, which is positioned on the supporting surface 31 of the supporting frame 2, placed among or included in the group of products 100 (i.e. interposed and in contact with said products 100) and including a first computing unit that is connected to the first detecting module 3 to receive and process data related to the first physical quantities a, co and save said data in a first memory unit 17 so as to form a first measurement chain 10 of the first physical quantities a, co. The latter ones include physical quantities of the kinematic type, in particular linear accelerations a along three orthogonal axis and angular speeds co according to three orthogonal axis, acting on said measuring system 1 and said group of products 100 during movement and transport.

The processing module 5 also includes a second computing unit 7 that is connected to the second detecting module 4 to receive and process data related to second physical quantities t, p, u and save said data in a second memory unit 18 so as to form a second measurement chain 20 of the second physical quantities t, p, u. The latter ones include environment-type physical quantities, in particular temperature t, pressure p, humidity u of an environment wherein the measuring system 1 and the group of products 100 are during movement and transport.

The processing module 5 has dimensions and weight comparable to those of one of the products 100 so as not to modify the weight mass distribution and dynamic behaviour of the group of products 100, the dynamic behaviour meaning the kinematic, dynamic, structural response or reaction of the load when subjected to stresses such as linear, angular speeds, accelerations/decelerations, vibrations, oscillations, etc.

The first computing unit 6 and/or the second computing unit 7 can be further programmed and configured so as to process the data respectively received by the first detecting module 3 and/or by the second detecting module 4 and obtain processed and/or filtered data to be saved in the memory units 17, 18. For example, data obtained by the detecting modules 4, 5 can be processed by the computing units 6, 7 in the frequency domain, through suitable algorithms based on the Fourier transform (and its variants). Such algorithms allow, as known, to perform a sampling of the signals acquired in the domain of time, their transformation in the domain of frequencies and a following digitalization without reducing the information content, thus obtaining data that can be more easily interpreted and analysed, at the same time reducing the computing complexity and the memory filling. The first detecting module 3 comprises a first microprocessor 15 suitable to receive and process data detected by first sensor means 13 with the first acquisition time t1 and to transmit said data to the first computing unit 6 of the processing module 5. Similarly, the second detecting module 4 comprises a second microprocessor 16 suitable to receive and process data detected by second sensor means 14 with the second acquisition time t2 and transmit said data to the second computing unit 7 of the processing module 5.

As it will be better described in the following, the two data acquisition times t1, t2 are different and in particular the first data acquisition time t1 of the first measurement chain 10 is smaller than the second data acquisition time t2 of the second measurement chain 20. The processing module 5 further includes two different power supply units 26, 27 for electrically powering the two measurement chains 10, 20, separately and independently. More precisely, the processing module 5 comprises a first power supply unit 26 to electrically power the first measurement chain 10, that is to power the first computing unit 6, the first memory unit 17 and the first detecting module 3, and a second supply unit 27 to electrically power the second measurement chain 20, that is to power the second computing unit 7, the second memory unit 18 and the second detecting module 4.

The power supply units 26, 27 are batteries or electrical accumulators capable to provide the measurement chains 10, 20 with an adequate operative autonomy.

In the shown and disclosed embodiment, the second detecting module 4 of the measuring system 1 also comprises third sensor means 19 connected to the second microprocessor 16 and arranged to measure a position of the measuring system 1 with respect to an external environment, that is to measure a distance of palletized load 110 from an external reference (for example walls of a truck load compartment). The second microprocessor 16 receives and processes data detected by the third sensor means 14 with a third acquisition time t3 and transmits said data to the second computing unit 7 of the processing module 5. The third sensor means 19 are therefore included in the second measurement chain 20. Computing units 6, 7 of processing module 5 include respective single-board electronic computers, so called micro PC, for example micro PC Raspberry Pi, capable to receive and process data from microprocessors 15, 16 of the detecting modules 3, 4 and to save or store said data in the respective memory units 17, 18.

The first microprocessor 15 and the second microprocessor 16 comprises, for example, respective integrated microprocessors provided with specific programmes for deleting errors (debugger) and for programming (programmer) capable to analyse and transmit, especially via cable, data coming from the sensor means 13, 14.

The first sensor means comprises a first sensor integrated unit 13, in particular an integrated electronic unit or board, provided with MEMS (Micro Electro Mechanical Systems) sensors, suitable to detect and measure at least the first physical quantities of kinematic type, in particular linear accelerations a along three orthogonal axis and angular speeds co according to three orthogonal axis. To this end, the first sensor integrated unit 13 includes at least a three-axial accelerometer and a three-axial gyroscope.

The second sensor means comprises a second sensor integrated unit 14, in particular an integrated electronic unit or board, provided with MEMS (Micro Electro Mechanical Systems) sensors, suitable to detect and measure at least the second physical quantities of environment-type, in particular temperature t, pressure p, humidity u. To this end, the second sensor integrated unit 14 includes at least a humidity and temperature sensor and a pressure sensor.

In the illustrated embodiment, the first sensor integrated unit 13 and the second sensor integrated unit 14 include respective integrated electronic boards, that are identical and provided with MEMS sensors, each of which provided with a three-axial accelerometer, a three-axial gyroscope, a humidity and temperature sensor and a pressure sensor. As better explained in the hereinafter description, only some of these sensors are used by each detecting module 3, 4

The third sensor means 19 comprises at least two proximity sensors 19*a*, 19*b* suitable to measure along two substantially orthogonal axis distances d1, d2 separating the measuring system 1, that is the palletized load 110, from walls of an external environment, e.g. of a load compartment of a means of transport, in order to measure possible displacement or sliding of the palletized load 110 during transport. In particular, the third sensor means comprises a third integrated electronic unit or board 19 provided with two proximity sensors 19*a*, 19*b* and connected to the second microprocessor 16 to transmit data related to the detected distances. The third sensor means 19 and/or the second microprocessor 16 are configured so as to detect and measure distances d1, d2 with the third data acquisition time t3, which is longer than the first data acquisition time t1 and shorter than the second data acquisition time t2.

Proximity sensors 19*a*, 19*b* are, for example, proximity and ambient light sensors, which operate using the technology Time of Flight (ToF). This technology provides enlightening the environment where measuring is to be performed with a source of modulated light so that the proximity sensor can detect luminous pulses reflected by the object (from which the distance is measured by the sensor), transform such pulses into electric signals and transmit the signals to the processor ToF that measures the phase displacement between the emitted light and the reflected light; such phase displacement allows to calculate the distance from the object. In fact, the processor detects the time taken by the light pulse to carry out the itinerary from the source to the object and back to the sensor, namely the so called "Time of Flight".

Figure 2:
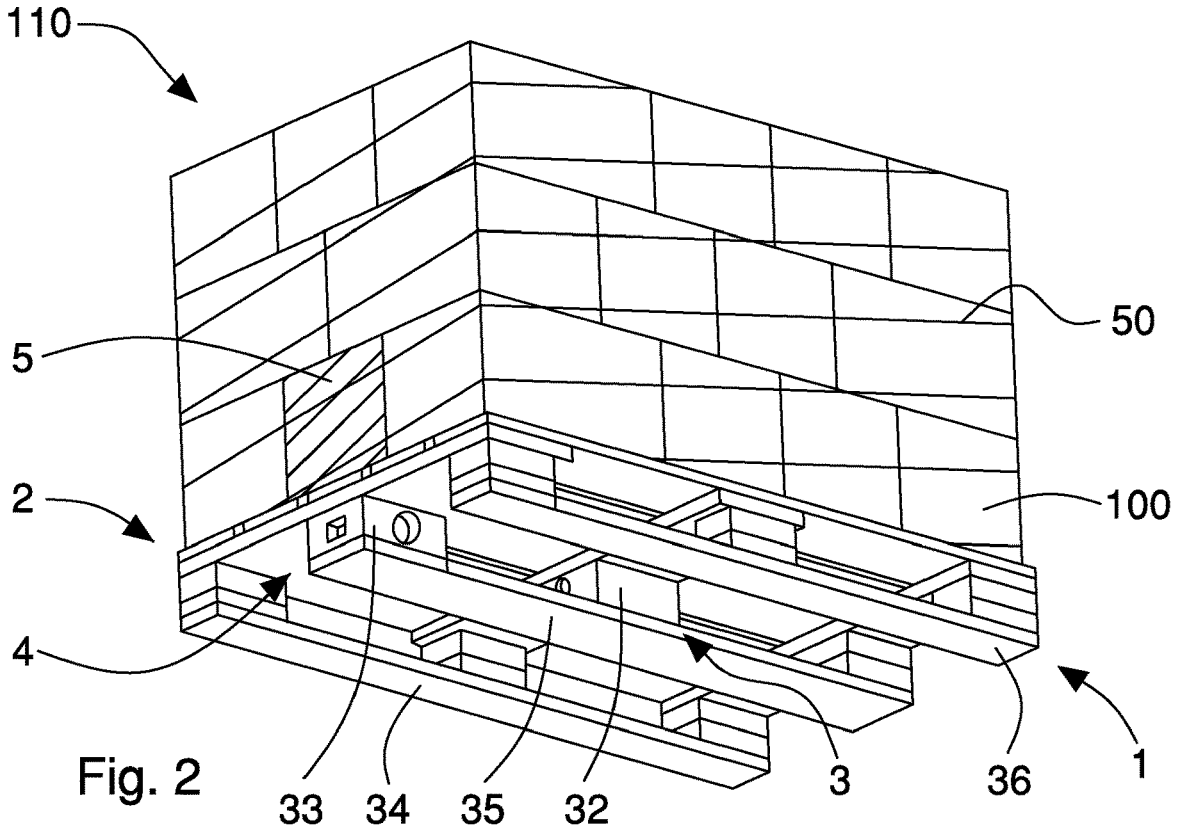
FIG. 2 is a bottom perspective view of the measuring system of FIG. 1 that is associated to a group of superimposed products, grouped and wrapped with a plastic film for forming a palletized load.
Figure 3:
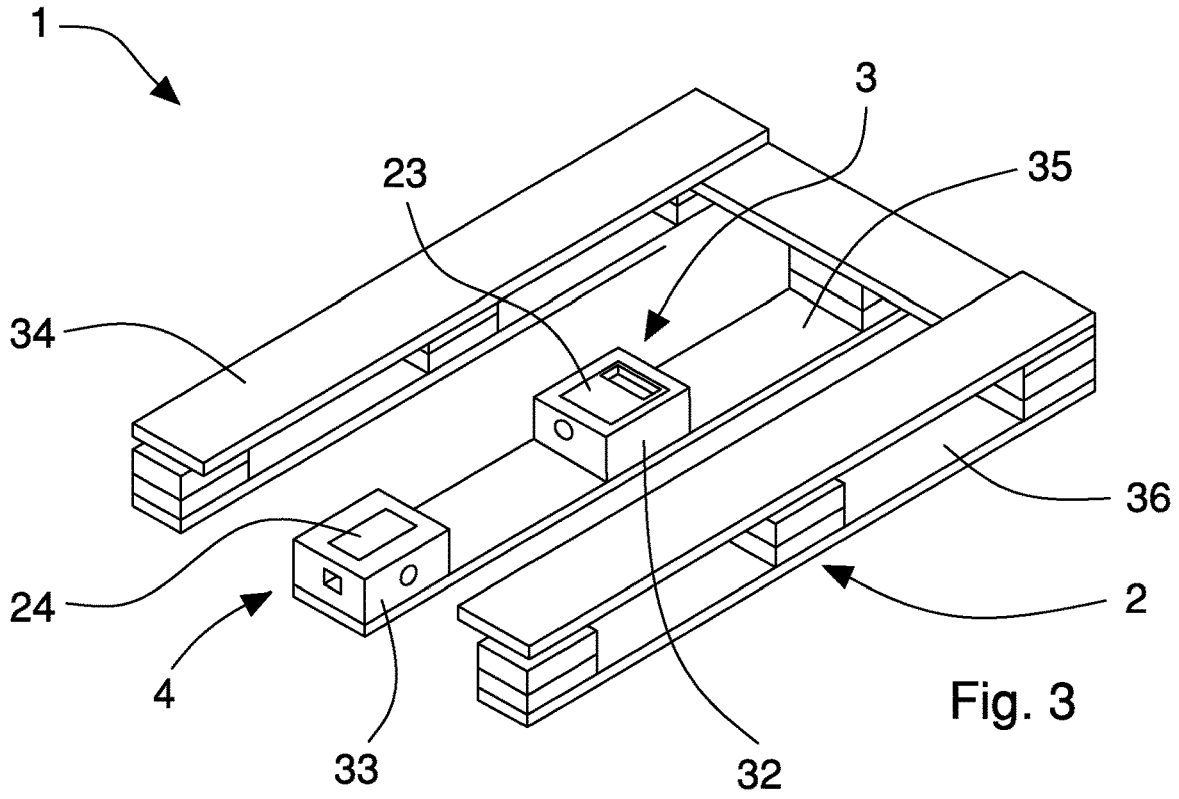
FIG. 3 shows a perspective schematic view of the supporting frame of the measuring system of FIG. 1, wherein some parts have been removed in order to better highlight a first and a second detecting module.
Figure 4:
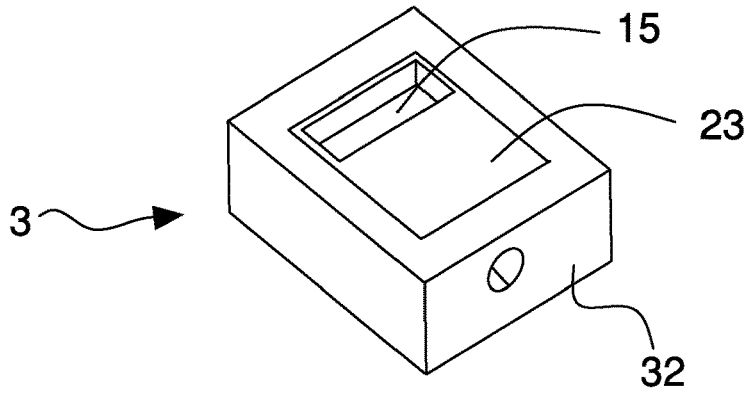
FIG. 4 is a perspective enlarged view of the first detecting module of the measuring system of FIG. 1.
Figure 5:
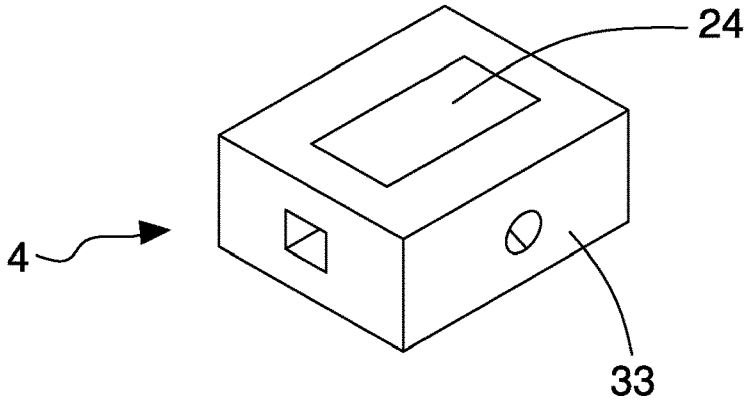
FIG. 5 is a perspective enlarged view of the second detecting module of the measuring system of FIG. 1.
Figure 6:
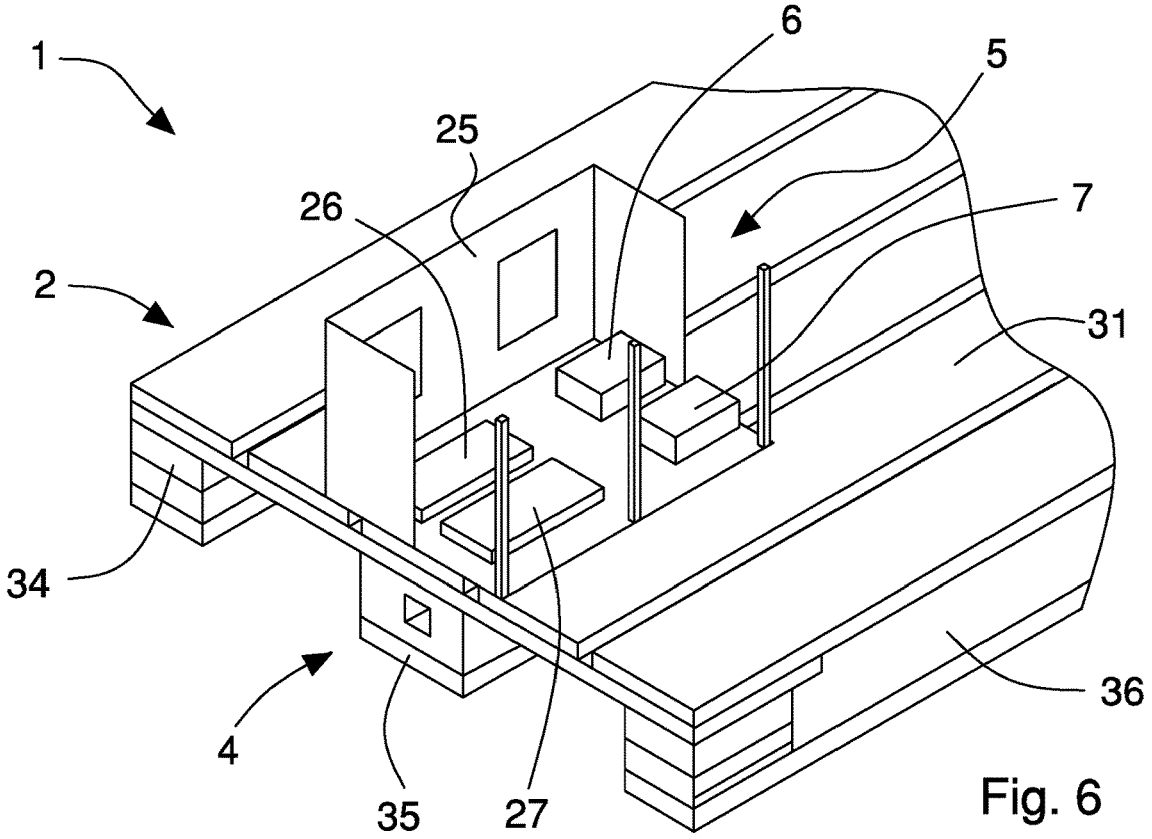
FIG. 6 is a perspective partial view of the measuring system of the invention wherein a casing of the processing module is partially disassembled.
Figure 7:
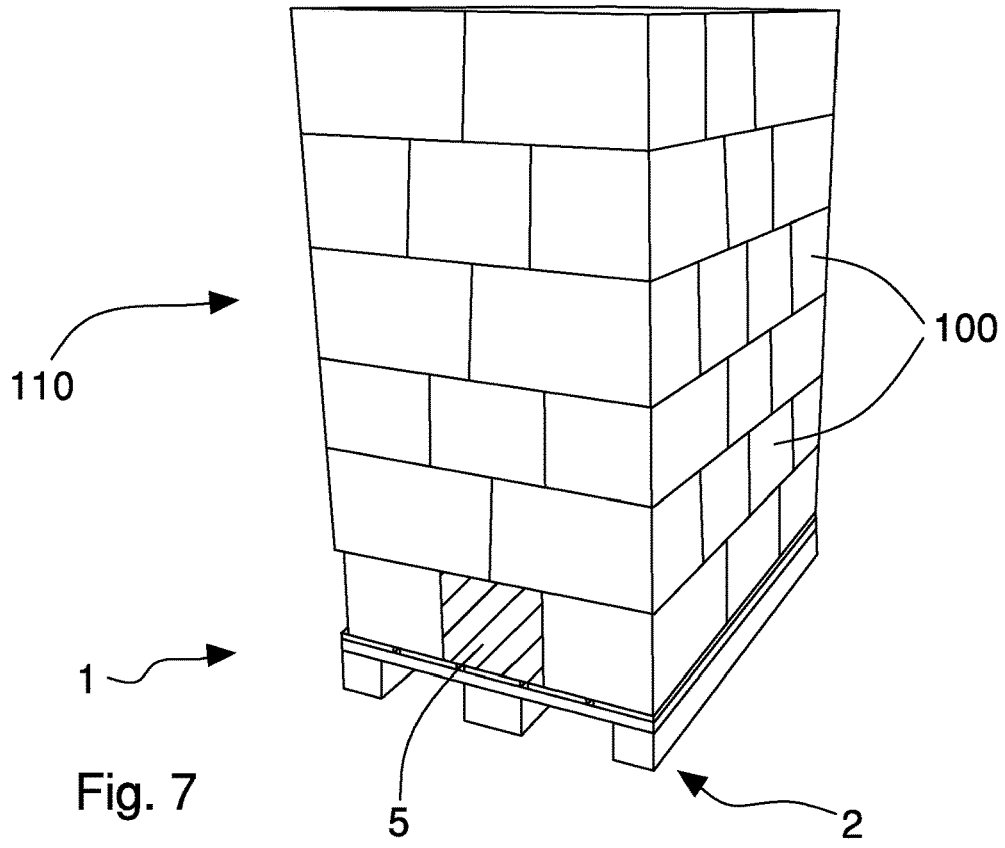
FIG. 7 is a block diagram showing measurement chains formed by the components of the detecting modules and processing module of the measuring system of the invention.

Referring in particular to FIGS. 1 to 3, the supporting frame 2 is substantially a pallet, made of wood, metal or plastic and almost identical to the pallets normally used to package groups of products with wrapped with bands or strips of film in such a way as to form a palletized load. The supporting frame 2 has the dimensions of the standard pallets existing on the market, for example the dimensions 1200×800 mm (length by width) of a Euro Pallet.

As shown in the figures, the supporting frame or pallet 2 includes three spars 34, 35, 36 arranged in parallel and spaced apart between them, on the upper part mutually connected by the supporting plane 31. The longitudinal spaces among the spars 34, 35, 36 allow to insert the lift forks.

In one of the spars, for example in the central spar 35, the two detecting modules 3, 4 are inserted and fixed.

Each detecting module 3,4 comprises a respective container 23, 24, in particular made of plastic material, inside which respective sensor means 13, 14 and microprocessor 15, 16 are fixed. The containers 23, 24 are inserted and fixed inside a respective supporting element 32, 33 of the supporting frame 2, in particular of the central spar 35.

More precisely, a first container 23 of the first detecting module 3 is inserted, in particular press-fitted, inside a first central supporting element 32 of the central spar 35, while a second container 24 of the second detecting module 4 is inserted, in particular press-fitted, inside a second peripheral supporting element 33 of the central spar 35. The second container 24 and the second peripheral supporting element 33 have respective aligned through openings which allow the proximity sensors 19*a*, 19*b* of third sensor means 19 to measure respective distances that separate the latter, i.e. the measuring system 1, from two orthogonal references, for example the walls of a load compartment.

The two supporting elements 32, 33 are inserted and tightly fastened inside the structure of central spar 35.

To be noted that the containers 23, 24, made of plastic material, in particular ABS, ensure a high strength, rigidity and duration so as to guarantee the containment and protection of electronic components inserted therein. Sensor integrated boards or units 13, 14 and microprocessors 15, 16 are tightly fixed inside the respective containers 23, 24 for example through suitable fixing plates, so that free movements and/or vibrations of the sensor integrated boards that may hinder and alter measuring are prevented.

To be noted also that the weight of detecting modules 3, 4 and related containers 23, 24 is limited and such as not to modify the overall weight of the supporting frame 2 which is substantially equal to that of usually used supporting frames or pallets. Similarly, positioning of detecting modules 3, 4 inside the supporting frame 2, in particular inside the supporting elements 32, 33 of the central spar 35, does not affect weight/mass distribution of the supporting frame 2 and its dynamic behaviour when associated and fastened to the products 100 and subjected to stresses (linear, angular speeds, accelerations/decelerations, vibrations, oscillations, etc.) when moved and transported.

The processing module 5 also comprises a respective casing 25 suitable to house therein the two computing units 6, 7, the external memory units 17, 18 and the power supply units 26, 27.

To be noted that the processing module 5 with its casing 25 has dimensions and weight comparable to those of one of the products 100 to be wrapped, so that weight, geometry and structure of the palletized load 110 to be measured is not affected. Thereby, weight and dynamic behaviour of the palletized load 110 (including the supporting frame 2 provided with the detecting modules 3, 4 and the processing module 5) are almost equal to weight and dynamic behaviour of a palletized load formed by the same group of products 100 positioned on a standard pallet.

Figure 8:
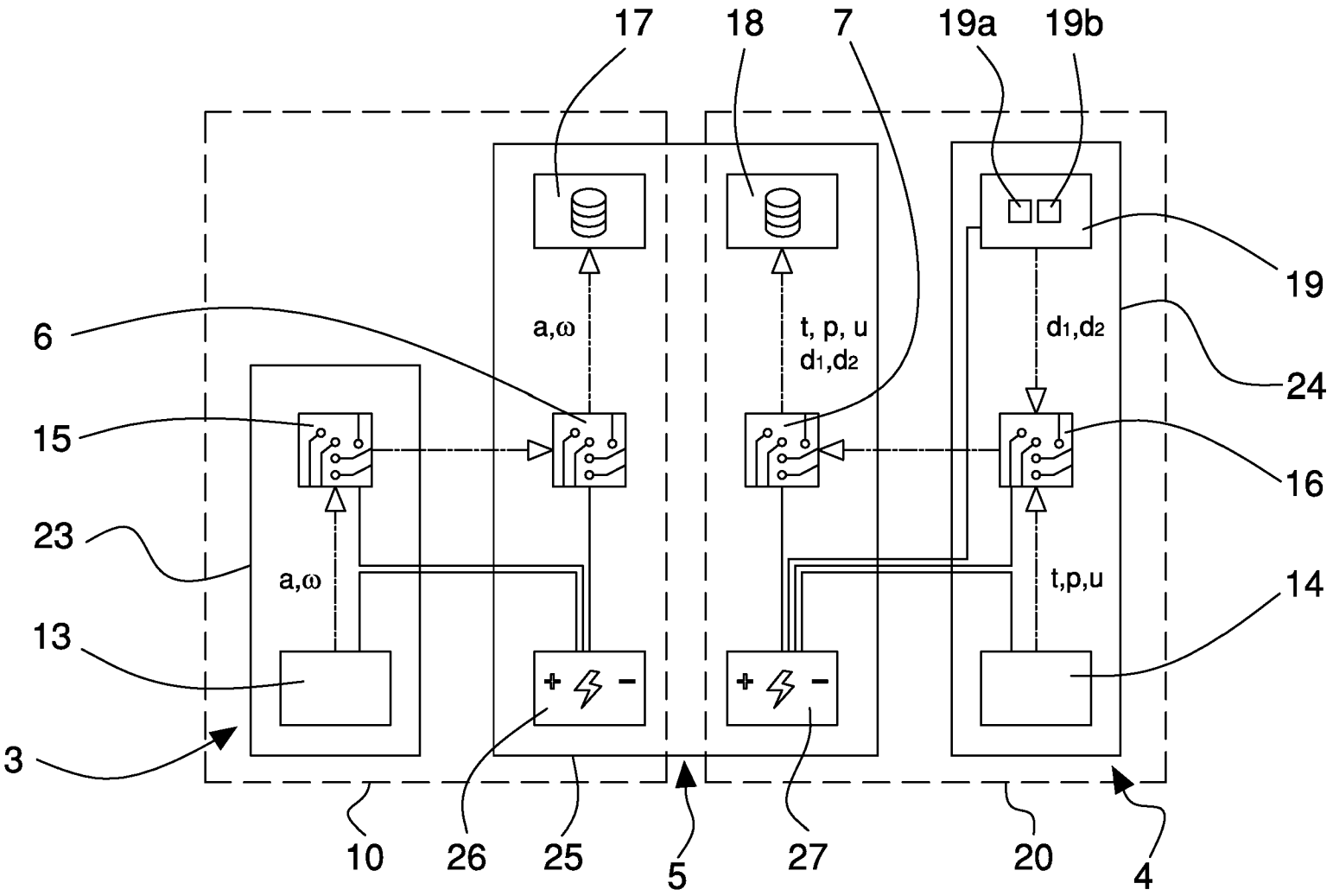
FIG. 8 is a top perspective view of the measuring system of the invention associated with a different group of stacked products, grouped and wrapped with a plastic film.

Therefore, the containment casing 25 will change according to the products 100 to be wrapped and hence it will have different weight and dimensions. For example, its dimensions and weight will change in case of bundles 6×4 of 0.5-litre bottles of water (FIG. 8) or bundles of 6×2 of 2-litre bottles of water.

Since the processing module 5 is positioned on the supporting plane 31 of the supporting frame 2 at the detecting modules 3, 4 in order to simplify the wiring of the latter ones, the casing 25 will have to be strong enough to bear the weight and stresses of the adjacent and overlying products 100.

In the case of bottle bundles, the casing 25 is a closed box structure made of sheet metal. In use, the supporting frame or pallet 2 of the measuring system 1 is loaded with a definite number of products 100 arranged according to pre-set rows on different layers, substantially reproducing a pallet loading configuration used in the ordinary production. The processing module 5 of the measuring system 1, which has dimensions and weight equal to those of a product 100, is previously positioned on the supporting plane 31 of the pallet 2 in replacement of an original product 100. However, as already said, as its dimensions and weight are substantially comparable to those of the replaced product, the group of products so formed has almost the same structure and dynamic behaviour of a group of products of the production.

Then the measuring system 1 and the group of products 100 associated therewith are wrapped with a cold-stretchable plastic film by a wrapping machine, known and not illustrated, in order to form the palletized load 10. Wrapping is performed according to an initial wrapping configuration defined by pre-set wrapping parameters (pre-stretching percentage, number of wrappings, overlying of film bands, etc.) selected according to the type of products 100 (fragile, irregular, unstable, etc.).

A palletized load 110 is obtained that is almost equal to palletized loads obtained in the ordinary production. Detecting modules 3, 4 inserted in the pallet 2 allow to measure physical quantities acting on the palletized load 110 when the latter is moved and transported.

In particular, by means of the first measurement chain 10 it is possible to measure and save data related to kinematic quantities such as accelerations a and angular speeds co acting on the palletized load 110 when transported. These two kinematic quantities measured on the three axis precisely describe the dynamic stress (vibrations, oscillations, . . . ) the palletized load 110 is subjected to and which can cause inclination, deformation, collapse of the palletized load with resulting damage and deformation of products 100.

The second measurement chain 20 allows to measure and save environment quantities (temperature, pressure, humidity) and measuring possible displacement or sliding of the palletized load 110 during the transport. As known, relevant variations in the environment quantities, in particular, temperature and humidity, may strongly affect the quality of the film wrapping.

The second measurement chain 20 also allows, thanks to third sensor means 19 that comprises two proximity sensors 19*a*, 19*b*, to measure the distances d1, d2, which separate the palletized load 110 from walls of an external environment, so as to verify if the fixing modes of the palletized load on the means of transport were suitable or not sufficient. To be noted that the measuring system 1 of the invention measures physical quantities, in particular kinematic quantities, directly on the supporting frame or pallet 2 i.e. on the body (typically fixed to the loading platform of the means of transport) which undergoes stresses and transfers such stresses to the overlying load. Hence physical quantities acting on the means of transport are not measured nor those detected by sensors directly fixed to the products.

By using two different measurement chains 10, 20 the measuring system 1 of the invention can obtain extremely precise and accurate measurements of the physical quantities, in particular of the kinematic quantities. Furthermore, by using two measurement chains formed by respective and separate detecting modules 3,4, microprocessors 15, 16, computing units 6,7, memory units 17, 18 and power supply units 26, 27 ensures greater reliability, safety and operative autonomy to the measuring system 1.

More precisely, the first measurement chain 10, which uses MEMS sensors linear three-axial accelerometer and three-axial gyroscope of the first sensor integrated unit 13, allows to have a very short first data acquisition or reading time t1 (e.g. about 5-10 ms), for instance the minimum acquisition time allowed by the electronic components, in order to have the highest sampling frequency and to be able to analyse the signals, in particular in the frequency domain, in a wide bandwidth. Tests carried out by the Applicant showed in fact that values of linear accelerations and angular speeds (six values on three axes) must be acquired together, with the same sampling time, in order to detect and define the kinematic and dynamic behaviours of the palletized load 110.

These high performances may be obtained as in the first measurement chain 10 only data related to first physical quantities are detected, processed and saved while data related to second physical environment quantities are not taken in consideration; in other words temperature, humidity and pressure sensors of the first sensor integrated unit 13 are not used.

Data relative to second physical environment quantities t, p, u are detected, processed and saved with a second data acquisition time t2 having much higher value (for example 60s) by the second measurement chain 20 using the humidity and temperature MEMS sensor and pressure MEMS sensor of the second sensor integrated unit 14.

The same second measurement chain 20 allows to process and save data relative to distances d1, d2, which are detected and measured by the two proximity sensors 19*a*, 19*b* of the third electronic integrated unit 19 and transmitted to the second processor 16 with a third data acquisition time t3, having a value (for example 100 ms) higher than the first data acquisition time t1 and shorter than the second data acquisition time t2.

Thus, it is possible for the first computing unit 6 and the second computing unit 7 to process and save in complete and accurate way all the data from the respective detecting modules 3, 4.

The advantage of performing the measurement of physical quantities by means of two distinct measurement chains 10, 20 is even more evident in the case wherein computing units 6, 7 in a variant of the measuring system 1 of the invention, are programmed and configured to process data acquired respectively from the first detecting module 3 and/or the second detecting module 4 in order to obtain processed and/or filtered data, in particular in the frequency domain, to be saved in the memory units 17, 18.

The measuring method of the invention to measure physical quantities acting on a palletized load 100 formed by a group of products 100 wrapped by a plastic film 50 when the palletized load is moved and/or transported using the above described measuring system 1 provides:

- detecting and measuring with a first data acquisition time t1 first physical quantities a, ω, acting on the palletized load 110 by means of a first measurement chain 10 of the measuring system 1, in particular said first physical quantities comprising kinematic quantities, such as linear acceleration a, angular speed ω;
- detecting and measuring with a second data acquisition time t2 second physical quantities t, p, u, acting on said palletized load 110 by means of a second measurement chain 20 of the measuring system 1, in particular said second physical quantities comprising environment physical quantities, such as temperature t, pressure p, humidity u.

Furthermore, the method provides storing data related to first physical quantities and second physical quantities respectively by the first measurement chain 10 and second measurement chain 20.

According to the method of the invention, the first data acquisition time t1 of the first measurement chain 10 is shorter than the second data acquisition time t2 of the second measurement chain 20; in particular, the first data acquisition time t1 is equal to a minimum acquisition time of the first measurement chain 10.

It is further provided processing data related to first physical quantities a, co and/or data related to second physical quantities t, p, u in order to obtain processed and/or filtered data to be saved, in particular said processing comprising processing said data in the frequency domain through the Fourier transform (or variants thereof).

The measuring system and method of the invention allow to detect and measure in a precise and accurate way kinematic and environment physical quantities acting on a palletized load 110 when the latter is moved, in particular along a transport itinerary on one or more means of transport.

The palletized load 110 is formed by a definite number of products 100 arranged side by side and superimposed according to a definite order (number of rows and layers), enveloped and wrapped by a plastic film 50 according to a pre-set wrapping configuration that is defined by pre-set wrapping parameters (pre-stretching percentage, wrapping force, number of wrappings of the film around the load) selected according to characteristics of the plastic material film (composition, initial thickness) and of the type of load (fragile products, number, positioning, etc.)

Data obtained by the measuring system 1 of the invention allow to know the stresses the palletized load 110 is subjected to in order to optimize the wrapping configuration for instance changing the wrapping parameters, and to verify that the palletized load 110 has been correctly fixed and fastened to the means of transport.

Physical quantities data, in particular kinematic quantities, in fact may be used to verify in one simulation the different effects on the palletized load obtained, with the same transport itinerary and various movement operations, by changing the wrapping configurations in order to optimize the latter ones.

The method of the invention for wrapping a group of products 100 with a plastic film 50 comprises:

- wrapping with a plastic film 50 according to an initial wrapping configuration a palletized load 110 formed by the group of products 100 and by the above described measuring system 1;
- measuring physical quantities a, co, t, p, u acting on the palletized load 110 when the latter is moved and/or transported;
- calculating an optimal wrapping configuration based on data related to physical quantities a, co, t, p, u and measured and processed by the measuring system;
- wrapping the group of products 100 with the plastic film 50 according to the optimal wrapping configuration.

The initial and optimal wrapping configurations comprise respective sets of wrapping parameters (pre-stretching percentage, wrapping strength, number of wrappings of the film around the load, overlaying of film bands, . . . ) selected according to the type of products 100 (fragile, irregular, unstable, etc.), the type of palletized load (dimensions) and the characteristics of the film 50 (width, thickness, density, composition, etc.).

The optimal wrapping configuration may coincide with the initial wrapping configuration, typically when the latter already guarantees a right containment and stabilization of the load.

According to the wrapping method of the invention, measuring physical quantities includes:

detecting and measuring with a first data acquisition time t1 first physical quantities a, ω acting on the palletized load 110 by means of a first measurement chain 10 of the measuring system 1, in particular the first kinematic quantities comprising kinematic-type quantities a, ω;

detecting and measuring with a second data acquisition time t2 second physical quantities t, p, u acting on the palletized load 110 by means of the second measurement chain 20 of the measuring system 1, in particular the second physical quantities comprising environment-type quantities t, p, u.

It is also provided saving data related to the first physical quantities a, co and the second physical quantities t, p, u respectively by means of the first measurement chain 10 and the second measurement chain 20.

The first data acquisition time t1 of the first measurement chain 10 is shorter than the second data acquisition time t2 of the second measurement chain 20; in particular, the first data acquisition time t1 is equal to a minimum acquisition time of the first measurement chain 10.

The method further provides processing data related to first physical quantities a, co and/or data related to second physical quantities t, p, u in order to obtain processed and/or filtered data to be saved, in particular said processing comprising processing said data in the frequency domain through Fourier transform (or variants thereof).

Thanks to the wrapping method of the invention by using data obtained by the measuring system 1—which allows to detect and measure physical quantities of the kinematic and environment type, occurring to the palletized load 110 wrapped with a defined initial wrapping configuration when the palletized load is moved and/or transported—it is possible to determine an optimal wrapping configuration for the group of products 100, that is a wrapping configuration with the film 50 which allows to obtain an optimal containment and stabilization of the group of products 100 during movement and/or transport and, at the same time, a reduction in the quantity of film used.

The optimal wrapping configuration may coincide with the initial wrapping configuration when data related to the first physical quantities measured by the measuring system 1 highlight correct containment and suitable stability of the palletized load 100 that is transported.

The invention claimed is:

1. A measuring system intended to be associated with a group of products and to be wrapped with a plastic film together with the group of products to form a palletized load and arranged to measure a plurality of physical quantities acting on the palletized load when moved and/or transported, the measuring system comprising:

a supporting frame provided with a supporting plane for the group of products;

a first detecting module housed inside said supporting frame and provided with first sensors to detect and measure with a first data acquisition time first physical quantities acting on the palletized load;

a second detecting module housed in said supporting frame and provided with second sensors to detect and measure with a second data acquisition time second physical quantities acting on the palletized load; and a processing module positioned on said supporting plane, inserted among the products and having dimensions and weight comparable to those of one of the products, wherein said processing module comprises:

a first computing unit connected to said first detecting module for receiving and processing data related to the said first physical quantities and for saving the data on a first memory unit, wherein said first computing unit, said first memory unit and said first detecting module form a first measurement chain of the first physical quantities having the first data acquisition time; and a second computing unit connected to said second detecting module for receiving and processing data related to the second physical quantities and for saving the data on a second memory unit, wherein said second computing unit, said second memory unit and said second detecting module form a second measurement chain of the second physical quantities having the second data acquisition time.

2. The measuring system according to claim 1, wherein said first detecting module comprises a first microprocessor configured to receive and process data obtained by said first sensors and transmit the data to said first computing unit of said processing module, and wherein said second detecting module comprises a second microprocessor configured to receive and process data obtained by said second sensors and transmit the data to said second computing unit of said processing module.

3. The measuring system according to claim 2, wherein said second detecting module further comprises third sensors connected to said second microprocessor and arranged to detect and measure with a third data acquisition time a distance of the palletized load from an external reference, and wherein said third sensors are included in said second measurement chain.

4. The measuring system according to claim 2, wherein said first detecting module further comprises a first container inside which said first sensors and said first microprocessor are fixed, said first container being inserted and fixed inside a first supporting element of said supporting frame, and wherein said second detecting module further comprises a second container inside which said second sensors and said second microprocessor are fixed, said second container being inserted and fixed inside a second supporting element of said supporting frame.

5. The measuring system according to claim 3, wherein said third sensors comprise at least two proximity sensors configured to measure distances along two substantially orthogonal axes from the palletized load, the distances being distances of the palletized load from walls of an external environment.

6. The measuring system according to claim 1, wherein at least one between said first computing unit and said second computing unit is programmed and arranged to process data received respectively from said first detecting module and said second detecting module in order to obtain processed and/or filtered data to be respectively saved in said first memory unit and said second memory unit.

7. The measuring system according to claim 1, wherein said processing module further comprises a first power supply unit connected to said first measurement chain to electrically power said first measurement chain and a second power supply unit connected to said second measurement chain to electrically power said second measurement chain.

8. The measuring system according to claim 1, wherein said processing module further comprises a respective casing configured to house therein said first and second computing units, said first and second memory units and power supply units of said first and second measurement chains.

9. The measuring system according to claim 1, wherein said first sensors comprise a first sensor integrated unit configured to detect at least the first physical quantities of kinematic-type.

10. The measuring system according to claim 9, wherein said second sensors comprise a second sensor integrated unit, and wherein said first sensor integrated unit and said second sensor integrated unit further comprise respective integrated electronic boards provided with MEMS sensors comprising a three-axial accelerometer, a three-axial gyroscope, a humidity and temperature sensor and a pressure sensor.

11. The measuring system according to claim 1, wherein said second sensors comprise a second sensor integrated unit configured to detect at least the second physical quantities of environment-type.

12. The measuring system according to claim 1, wherein said first and second computing units of said processing module comprise respective electronic computers with a single electronic board.

13. A method for measuring physical quantities acting on a palletized load formed by a group of products associated with a measuring system according to claim 1 and wrapped by a plastic film, when the palletized load is moved and/or transported, the method comprising:

detecting and measuring with the first data acquisition time the first physical quantities acting on the palletized load by means of said first measurement chain of said measuring system; and detecting and measuring with the second data acquisition time the second physical quantities acting on the palletized load by means of said second measurement chain of said measuring system.

14. The method according to claim 13, further comprising saving data related to the first physical quantities and the second physical quantities respectively by means of said first measurement chain and said second measurement chain.

15. The method according to claim 13, wherein the first data acquisition time of said first measurement chain is shorter than the second data acquisition time of said second measurement chain.

16. The method according to claim 13, further comprising processing data relative to the first physical quantities and/or data relative to the second relative physical quantities in order to obtain processed and/or filtered data to be saved.

17. A method for wrapping with a plastic film a group of products positioned on a supporting frame, the method comprising:

wrapping with the plastic film according to an initial wrapping configuration a palletized load formed by the group of products and a measuring system according to claim 1;

measuring physical quantities acting on the palletized load when the palletized load is moved and/or transported;

determining an optimal wrapping configuration based on data relative to the physical quantities, wherein the said data are measured and processed by the measuring system; and wrapping the group of products on the supporting frame with the plastic film according to the said optimal wrapping configuration.

18. The method according to claim 17, wherein the initial and optimal wrapping configurations comprise respective sets of wrapping parameters, which are selected according to characteristics of the plastic film, load and product.

19. The method according to claim 17, wherein the optimal wrapping configuration coincides with the initial wrapping configuration.

20. The method according to claim 17, wherein said measuring of the physical quantities comprises:

detecting and measuring with the first data acquisition time the first physical quantities acting on the said palletized load by means of said first measurement chain of said measuring system;

detecting and measuring with the a second data acquisition time the second physical quantities acting on the palletized load by means of said second measurement chain of said measuring system.

* * * * *